US010184290B2

(12) United States Patent
Briese et al.

(10) Patent No.: US 10,184,290 B2
(45) Date of Patent: Jan. 22, 2019

(54) WINDOW SPACER FRAME CRIMPING ASSEMBLY

(71) Applicant: GED Integrated Solutions, Inc., Twinsburg, OH (US)

(72) Inventors: William Briese, Hinckley, OH (US); Brady S. Jacot, Stow, OH (US); Paul A. Hofener, Parma, OH (US); John Grismer, Cuyahoga Falls, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 155 days.

(21) Appl. No.: 15/265,119

(22) Filed: Sep. 14, 2016

(65) Prior Publication Data

US 2017/0074031 A1 Mar. 16, 2017

Related U.S. Application Data

(60) Provisional application No. 62/218,781, filed on Sep. 15, 2015.

(51) Int. Cl.
*E06B 3/673* (2006.01)
*B21B 19/02* (2006.01)
(Continued)

(52) U.S. Cl.
CPC ..... *E06B 3/67313* (2013.01); *B21D 11/08* (2013.01); *B21D 53/74* (2013.01); *E06B 3/67365* (2013.01)

(58) Field of Classification Search
CPC ..... B21D 53/74; B21D 11/08; E06B 3/67365
See application file for complete search history.

(56) References Cited

U.S. PATENT DOCUMENTS 5,295,292 A 3/1994 Leopold
9,279,283 B2 * 3/2016 Briese ..... E06B 3/67308
(Continued)

FOREIGN PATENT DOCUMENTS

EP 0722812 7/1996

OTHER PUBLICATIONS

International Search Report and Written Opinion of International Patent Application No. PCT/US2016/051931, dated Nov. 18, 2016 (7 pages).

*Primary Examiner* — John C Hong
(74) *Attorney, Agent, or Firm* — John A. Yirga, Esq.; Tarolli, Sundheim, Covell & Tummino LLP

(57) ABSTRACT

An apparatus and method is provided for forming folds at a corner in a spacer frame assembly used in the construction of insulating glass unit windows. The apparatus comprises a carriage supporting first and second crimping fingers. The crimping fingers are spaced about a path of travel for the passage of metal strips during operation. The apparatus comprises an encoder to determine a velocity of the strips, and a motor coupled to a ball screw assembly. The ball screw assembly moves the carriage during operation along the path of travel. The apparatus comprises an electrical gearing arrangement for accelerating the carriage along the path. The electrical gearing arrangement includes a controller and a double acting rack assembly, the controller being coupled to the motor, the encoder, and the double rack assembly. The double rack assembly simultaneously actuates the fingers at a direction substantially transverse to the path.

20 Claims, 19 Drawing Sheets

(51) Int. Cl.
*B21D 11/08* (2006.01)
*B21D 53/74* (2006.01)

(56) References Cited

U.S. PATENT DOCUMENTS

| | | | | |
|---|---|---|---|---|
| 9,428,953 | B2 * | 8/2016 | Briese | E06B 3/66309 |
| 9,534,439 | B2 * | 1/2017 | Briese | E06B 3/67326 |
| 9,765,564 | B2 * | 9/2017 | Briese | E06B 3/663 |
| 2006/0075869 | A1 | 4/2006 | Calcel et al. | |
| 2007/0261247 | A1 | 11/2007 | Briese et al. | |

* cited by examiner

WINDOW SPACER FRAME CRIMPING ASSEMBLY

CROSS REFERENCES TO RELATED APPLICATIONS

The following application claims priority under 35 U.S.C. § 119 (e) to U.S. Provisional Patent Application Ser. No. 62/218,781 filed Sep. 15, 2015 entitled WINDOW SPACER FRAME CRIMPING ASSEMBLY. The above-identified application is incorporated herein by reference in its entirety for all purposes.

TECHNICAL FIELD

The present disclosure relates generally to insulating glass units and more particularly to a method and apparatus for fabricating a spacer frame for use in making a window.

BACKGROUND

Insulating glass units (IGUs) are used in windows to reduce heat loss from building interiors during cold weather. IGUs are typically formed by a spacer assembly sandwiched between glass lites. A spacer assembly usually comprises a frame structure extending peripherally about the unit, a sealant material adhered both to the glass lites and the frame structure, and a desiccant for absorbing atmospheric moisture within the unit. The margins or the glass lites are flush with or extend slightly outwardly from the spacer assembly. The sealant extends continuously about the frame structure periphery and its opposite sides so that the space within the IGUs is hermetic.

There have been numerous proposals for constructing IGUs. One type of IGU was constructed from an elongated corrugated sheet metal strip-like frame embedded in a body of hot melt sealant material. Desiccant was also embedded in the sealant. The resulting composite spacer was packaged for transport and storage by coiling it into drum-like containers. When fabricating an IGU the composite spacer was partially uncoiled and cut to length. The spacer was then bent into a rectangular shape and sandwiched between conforming glass lites.

Perhaps the most successful IGU construction has employed tubular, roll formed aluminum or steel frame elements connected at their ends to form a square or rectangular spacer frame. The frame sides and corners were covered with sealant (e.g., a hot melt material) for securing the frame to the glass lites. The sealant provided a barrier between atmospheric air and the IGU interior which blocked entry of atmospheric water vapor. Particulate desiccant deposited inside the tubular frame elements communicated with air trapped in the IGU interior to remove the entrapped airborne water vapor and thus preclude its condensation within the unit. Thus after the water vapor entrapped entrapped in the IGU was removed internal condensation only occurred when the unit failed.

In some cases the sheet metal was roll formed into a continuous tube, with desiccant inserted, and fed to cutting stations where "V" shaped notches were cut in the tube at corner locations. The tube was then cut to length and bent into an appropriate frame shape. The continuous spacer frame, with an appropriate sealant in place, was then assembled in an IGU.

Alternatively, individual roll formed spacer frame tubes were cut to length and "corner keys" were inserted between adjacent frame element ends to form the corners. In some constructions the corner keys were foldable so that the sealant could be extruded onto the frame sides as the frame moved linearly past a sealant extrusion station. The frame was then folded to a rectangular configuration with the sealant in place on the opposite sides. The spacer assembly thus formed was placed between glass lites and the assembly completed.

IGUs have failed because atmospheric water vapor infiltrated the sealant barrier. Infiltration tended to occur at the frame corners because the opposite frame sides were at least partly discontinuous there. For example, frames where the corners were formed by cutting "V" shaped notches at corner locations in a single long tube. The notches enabled bending the tube to form mitered corner joints; but afterwards potential infiltration paths extended along the corner parting lines substantially across the opposite frame faces at each corner.

Likewise in IGUs employing corner keys, potential infiltration paths were formed by the junctures of the keys and frame elements. Furthermore, when such frames were folded into their final forms with sealant applied, the amount of sealant at the flame corners tended to be less than the amount deposited along the frame sides. Reduced sealant at the frame corners tended to cause vapor leakage paths.

In all these proposals the frame elements had to be cut to length in one way or another and, in the case of frames connected together by corner keys, the keys were installed before applying the sealant. These were all manual operations which limited production rates. Accordingly, fabricating IGUs from these frames entailed generating appreciable amounts of scrap and performing inefficient manual operations.

In spacer frame constructions where the roll forming occurred immediately before the spacer assembly was completed, sawing, desiccant filling and frame element end plugging operations had to be performed by hand which greatly slowed production of units.

U.S. Pat. No. 5,361,476 to Leopold discloses a method and apparatus for making IGUs wherein a thin flat strip of sheet material is continuously formed into a channel shaped spacer frame having corner structures and end structures, the spacer thus formed is cut off, sealant and desiccant are applied and the assemblage is bent to form a spacer assembly. U.S. Pat. No. 5,361,476 is incorporated herein by reference in its entirety.

U.S. Pat. No. 7,448,246 illustrates a mechanical crimper having crimping fingers, imposing folds along the spacer frame by mechanically connecting slides, cylinders and the crimping fingers to the spacer frame while the spacer frame is being advanced. Stated another way, the crimping station included a number of slides and cylinders in addition to the crimping fingers that moved with the product by mechanically coupling the cylinders and fingers to the spacer while the material forming the spacer is advanced through the station. When the required number of crimps were complete, an additional cylinder was released from the spacer, allowing the crimper fingers and cylinders to be pulled back to a starting position by a mechanical spring. U.S. Pat. No. 7,448,246 is incorporated herein by reference in its entirety.

SUMMARY

One example embodiment of the present disclosure includes an apparatus and method for forming folds about one or more corners in a spacer frame assembly used in the construction of insulating glass unit windows. The apparatus comprises a carriage supporting first and second crimping fingers. The crimping fingers are spaced about a path of travel for the passage of metal strips during operation. The apparatus further comprises a motor coupled to a ball screw assembly, the ball screw assembly advancing and retracting the carriage during operation substantially along a portion of the path of travel. The apparatus additionally comprises an encoder located along the path of travel and upstream of the carriage. The encoder measures a velocity of a metal strip moving along the path of travel. The apparatus also comprises an electrical gearing arrangement for accelerating the carriage along the path of travel. The electrical gearing arrangement includes a controller and a double acting rack assembly, the controller being coupled to the motor, the encoder, and double rack assembly. The double rack assembly simultaneously actuates the fingers at a direction substantially transverse to the path of travel.

One example embodiment of the present disclosure includes a method for forming folds about a corner in a spacer frame assembly used in the construction of insulating glass unit windows. The method comprises sensing a notch utilizing a sensor in communication with a controller. Wherein, the notch is located on a continuously moving metal strip moving along a path of travel through a crimping assembly. The method thriller comprises measuring a velocity of the continuously moving metal strip along the path of travel utilizing an encoder in communication with the controller of the crimping assembly. The method additionally comprises accelerating the crimping assembly, responsive to sensing the notch, from a home position along the path of travel, utilizing an electrical gearing assembly in communication with the controller, the accelerating continuing until crimping fingers of the crimping assembly are even with the notch. Wherein, the crimping fingers are located downstream from the encoder and the sensor. The method also comprises actuating the crimping fingers to form a fold in the continuously moving metal strip at the notch.

One example embodiment of the present disclosure includes an apparatus and method for forming folds about one or more corners in a spacer frame assembly used in the construction of insulating glass unit windows. The apparatus comprises a carriage supporting first and second crimping fingers. The crimping fingers are spaced about a path of travel for the passage of metal strips during operation. The apparatus further comprises a motor coupled to a ball screw assembly, the ball screw assembly advancing and retracting the carriage during operation substantially along a portion of the path of travel. The apparatus additionally comprises an encoder located along the path of travel and upstream of the carriage and a sensor located along the path of travel between the encoder and the carriage. Wherein, the encoder measures a velocity of a metal strip moving along the path of travel and the sensor forms a light curtain transverse to the path of travel to detect a notch in the metal strip. The apparatus also comprises an electrical gearing arrangement for accelerating the carriage along the path of travel. The electrical gearing arrangement includes a controller and a double acting rack assembly, the controller being coupled to the motor, the encoder, the sensor, and double rack assembly. The double rack assembly simultaneously actuates the fingers at a direction substantially transverse to the path of travel.

BRIEF DESCRIPTION OF THE DRAWINGS

The foregoing and other features and advantages of the present disclosure will become apparent to one skilled in the art to which the present disclosure relates upon consideration of the following description of the invention with reference to the accompanying drawings, wherein like reference numerals, unless otherwise described refer to like parts throughout the drawings and in which.

Figure 1:
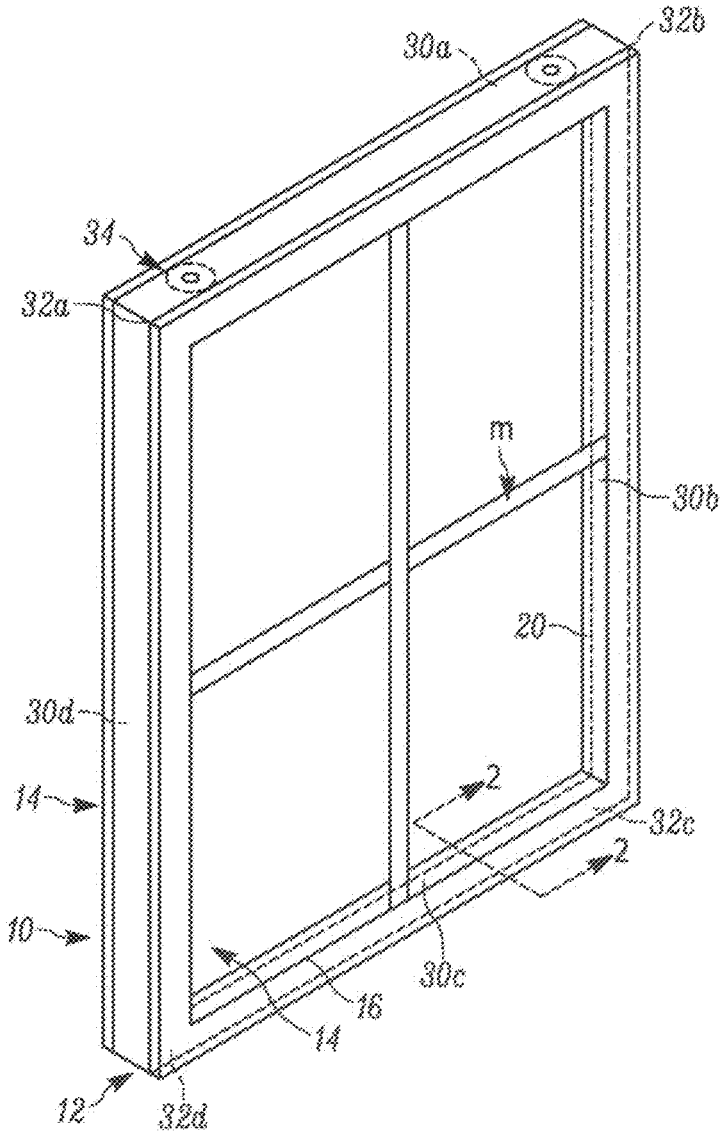
FIG. 1 (Prior Art)
FIG. 1 depicts a perspective view of an insulating glass unit.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures wherein like numbered features shown therein refer to like elements throughout unless otherwise noted. The present disclosure relates generally to insulating glass units and more particularly to a method and apparatus for fabricating a spacer frame for use in making a window.

The drawing Figures and specification disclose a method and apparatus for producing elongated spacer frames used in making insulating glass units. The method and apparatus are embodied in a production line which forms material into spacer frames for completing the construction of insulating glass units. While an exemplary system fabricates metal frames, the invention can be used with plastic frame material extruded into elongated sections having corner notches.

An insulating glass unit (IGU) 10 is illustrated in FIG. 1. The IGU includes a spacer assembly 12 sandwiched between glass sheets, or lites 14. The assembly 12 comprises a frame structure 16 and sealant material for hermetically joining the frame structure to the lites 14 to form a closed space 20 within the unit 10. The unit 10 as illustrated in FIG. 1 is in condition for final assembly into a window or door frame, not illustrated, for ultimate installation in a building. The unit 10 illustrated in FIG. 1 includes muntin bars M that provide the appearance of individual window panes.

Figure 2:
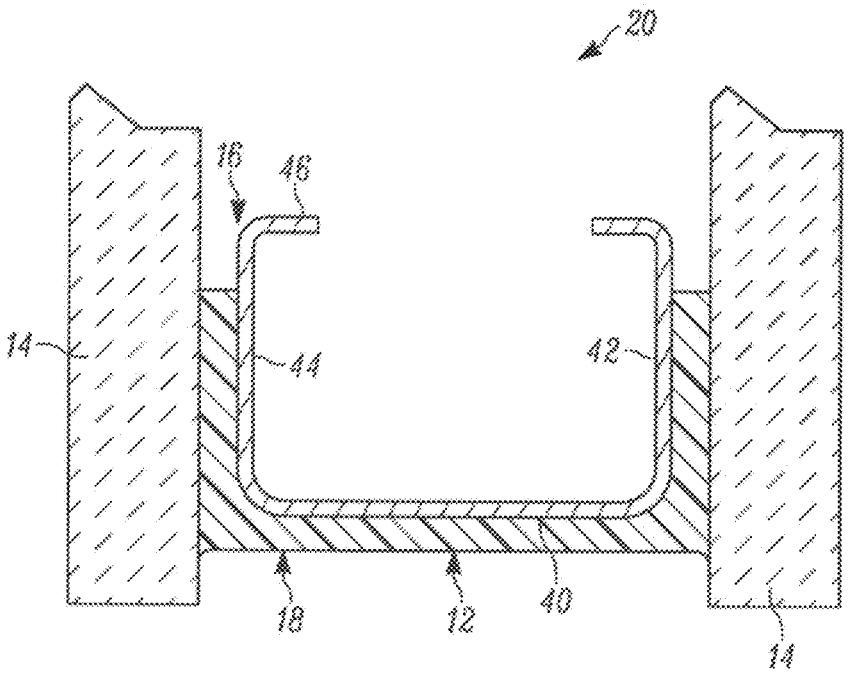
FIG. 2 (Prior Art)
FIG. 2 depicts a cross section taken along line 2-2 of FIG. 1.

In the illustrated example embodiment of FIG. 2, the assembly 12 maintains the lites 14 spaced apart from each other to produce the hermetic insulating "insulating air space" 20 between them. The frame 16 and a sealant body 18 co-act to provide a structure which maintains the lites 14 properly assembled with the space 20 sealed from atmospheric moisture over long time periods during which the unit 10 is subjected to frequent significant thermal stresses. A desiccant removes water vapor from air, or other volatiles, entrapped in the space 20 during construction of the unit 10.

The sealant body 18 both structurally adheres the lites 14 to the spacer assembly 12 and hermetically closes the space 20 against infiltration of airborne water vapor from the atmosphere surrounding the unit 10. One suitable sealant is formed from a "hot melt" material which is attached to the frame sides and outer periphery to form a U-shaped cross section.

Figure 3A:
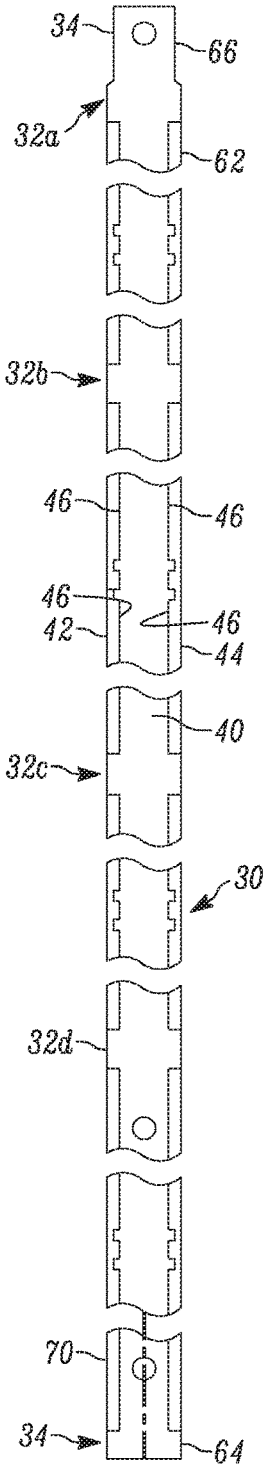
FIG. 3A depicts a top view of a spacer frame that forms part of the FIG. 1 insulating glass unit.
Figure 3B:
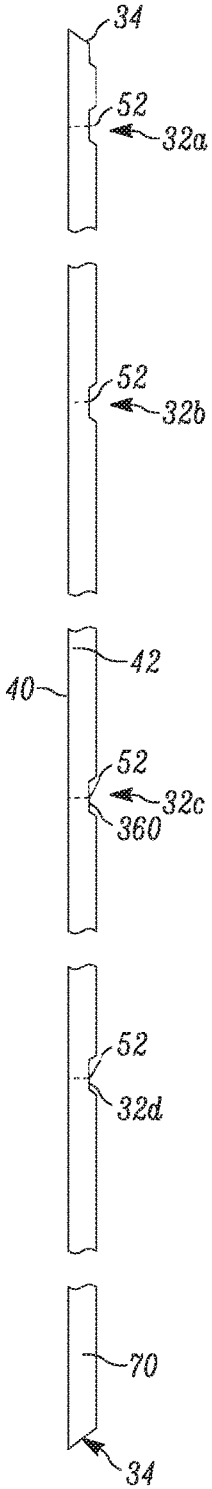
FIG. 3B depicts a side view of a spacer frame that forms part of the FIG. 1 insulating glass unit.

In the example illustrated embodiment of FIGS. 1, 3A, and 3B, the frame structure 16 extends about the unit 10 periphery to provide a structurally strong, stable spacer for maintaining the lites 14 aligned and spaced while minimizing heat conduction between the lites via the frame structure. The preferred frame structure 16 comprises a plurality of spacer frame segments, or members, 30*a*-30*d* connected to form a planar, polygonal frame shape, element juncture forming frame corner structures 32*a*-32*d*, and connecting structures 34 (FIG. 3A) for joining opposite frame element ends 62, 64 to complete the closed frame shape. Each of the corner structures 32*a*-32*d* are substantially triangularly-shaped with a central line of weakness 52, that when engaged by a crimping assembly 310, 410, as illustrated in FIGS. 5-10, and 17-19 allows a natural bending motion to form a substantially 90 degree corner were the corner structures are collapsed or folded inward by crimping fingers 342, 344 toward a channel of a strip 312, as illustrated in FIGS. 9, 10A, 10C, 11, and 14.

As illustrated in FIGS. 1, 2, 3A and 3B, each frame member 30*a*-30*d* is elongated and has a channel shaped cross section defining a peripheral wall 40 and first and second lateral walls 42, 44. The peripheral wall 40 extends continuously about the unit 10 except where the connecting structure 34 joins the frame member ends 62, 64. The lateral walls 42, 44 are integral with respective opposite peripheral wall edges. The lateral walls 42, 44 extend inwardly from the peripheral wall 40 in a direction parallel to the planes of the lites 14 and the frame 16. The illustrated frame 16 has stiffening flanges 46 formed along the inwardly projecting lateral wall edges. The lateral walls 42, 44 add rigidity to the frame members 30*a*-30*d* so the frame members resists flexure and bending in a direction transverse to the frame members longitudinal extent. The flanges 46 stiffen the walls 42, 44 so they resist bending and flexure transverse to their longitudinal extents.

Figure 10A:
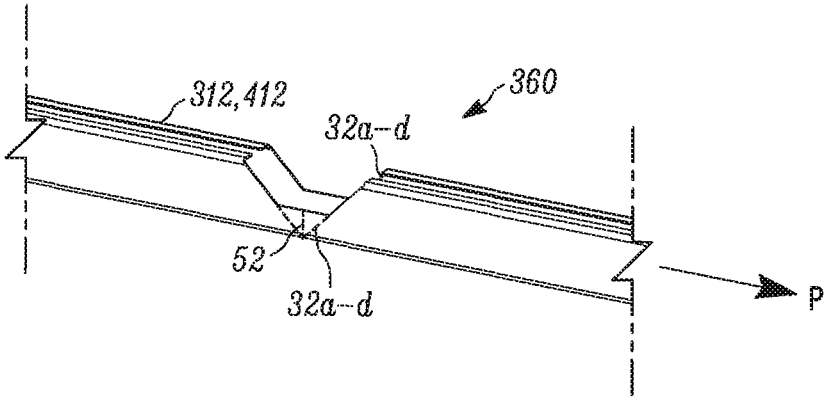
FIG. 10A depicts perspective view of a portion of a metal strip moving along a path of travel.
Figure 10B:
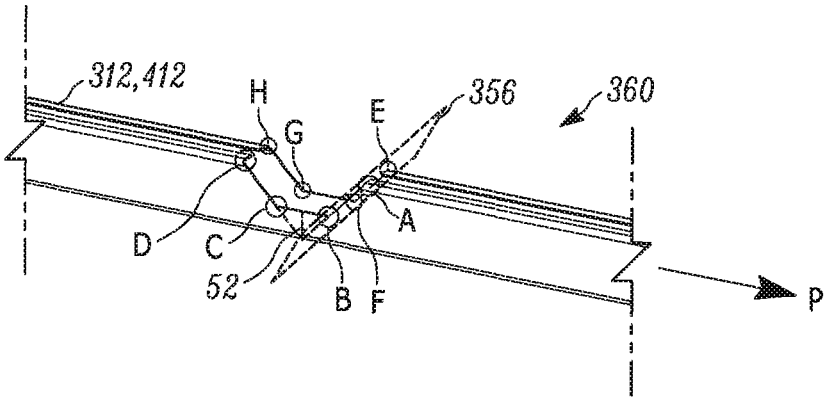
FIG. 10B depicts a side perspective view of a portion of a metal strip moving along a path of travel being scanned by a sensor's light curtain.
Figure 10C:
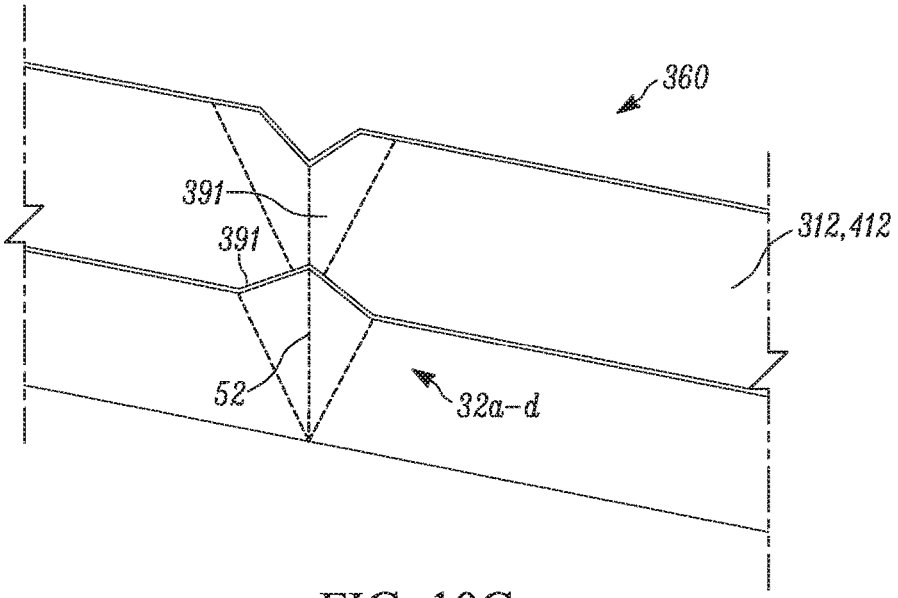
FIG. 10C depicts a upper perspective view of a metal strip after being crimped by a crimping assembly.

The frame 16 is initially formed as a continuous straight channel constructed from a thin ribbon of stainless steel material (e.g., 304 stainless steel having a thickness of 0.006-0.010 inches), as illustrated in FIGS. 3A and 3B. Other materials, such as galvanized, tin plated steel, aluminum or plastic, may also be used to construct the channel. As described more fully below, the corner structures 32*a*-30*d* are made to facilitate bending the frame channel to the final, polygonal frame configuration in the unit 10 while assuring an effective vapor seal at the frame corners. A sealant is applied and adhered to the channel before the corners are bent. The corner structures 32*a*-30*d* initially comprise notches 360, as illustrated in FIGS. 10A-10C, and weakened zones associated with the central line of weakness 52, formed in the walls 42, 44 at frame corner locations. See FIGS. 3A-3B. The notches 360 extend into the walls 42, 44 from the respective lateral wall edges. The lateral walls 42, 44 extend continuously along the frame 16 from one end to the other. The walls 42, 44 are weakened at the corner locations because the notches 360 reduce the amount of lateral wall material and eliminate the stiffening flanges 46 and because the walls are stamped to weaken them at the corners 32*a*-32*d*.

At the same time the notches 360 are formed, the weakened zones associated with the central line of weakness 52 are formed. These weakened zones are cut into the strip, but not all the way through. When this strip is roll formed, the weakened zones can spring back and have an outward tendency.

The connecting structure 34 secures the opposite frame ends 62, 64 together when the frame structure 16 has been bent to its final configuration. The illustrated connecting structure 34 of FIG. 3A comprises connecting tongue structure 66 continuous with and projecting from the frame structure end 62 and a tongue receiving structure 70 at the other frame end 64. The preferred tongue and tongue receiving structures 66, 70 are constructed and sized relative to each other to form a telescopic joint. When assembled, the telescopic joint maintains the frame structure 16 in its final polygonal configuration prior to assembly of the unit 10.

The Production Line 100

Figure 4:
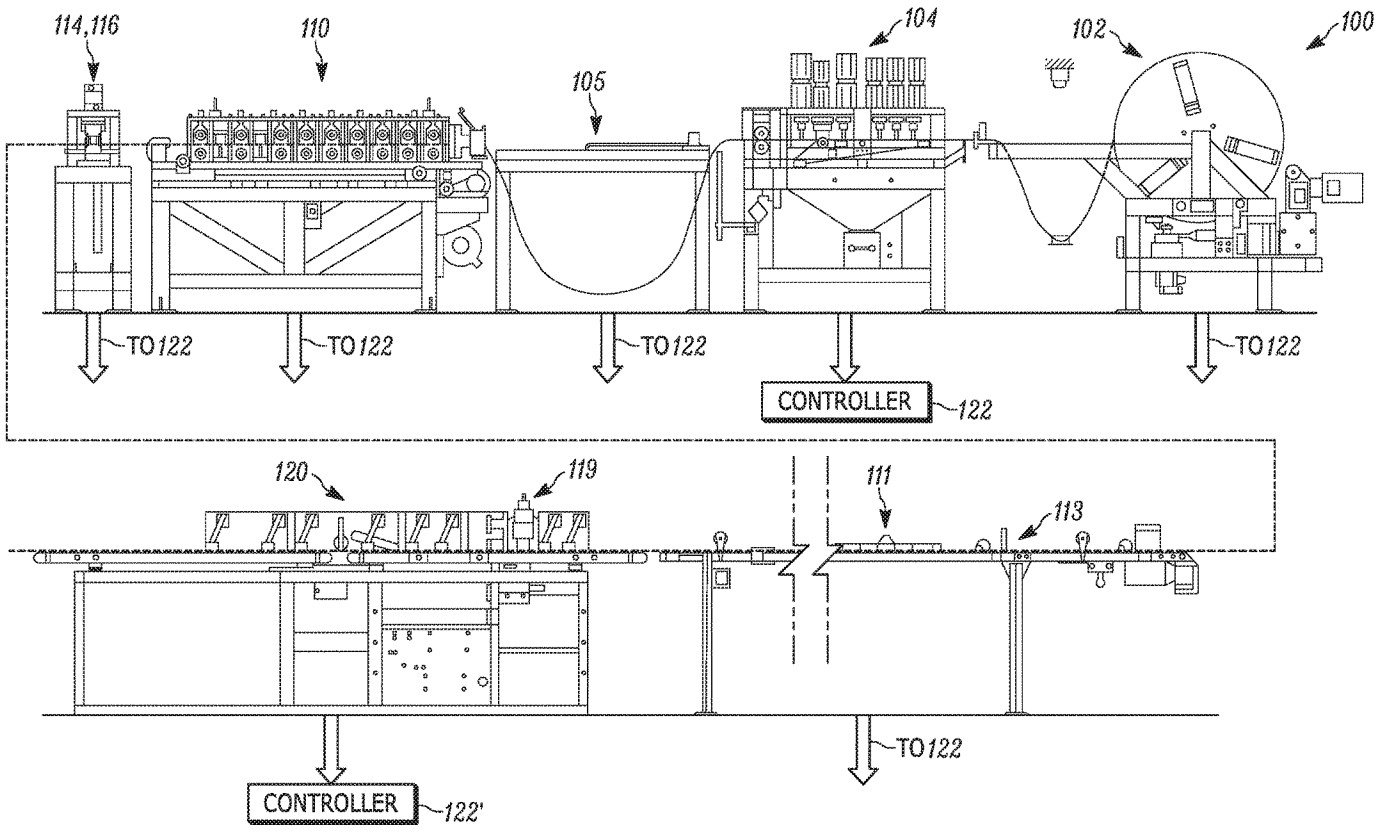
FIG. 4 depicts a schematic depiction of a production line in accordance with one example embodiment of the present disclosure.

As indicated previously the spacer assemblies 12 are elongated window components that may be fabricated by using the method and apparatus of the present invention. Elongated window components are formed at high rates of production. The operation by which elongated window components are fashioned is schematically illustrated in FIG. 4 as a production line 100 through which a thin, relatively narrow ribbon of sheet metal stock is fed endwise from a coil into one end of the assembly line and substantially completed elongated window components, e.g., the spacer assembly 12, emerge from the other end of the line 100.

The line 100 comprises a stock supply station 102, a first forming station 104, a transfer mechanism 105, a second forming station 110, third and fourth forming stations 114, 116, a conveyor 113, and a scrap removal apparatus 111, respectively, where partially formed frame members 30*a*-30*d* are separated from the leading end of the stock and frame corner locations are deformed preparatory to being folded into their final configurations, a desiccant application station 119 where desiccant is applied to an interior region of the spacer frame member, and an extrusion station 120 where sealant is applied to the yet to be folded spacer frame member. A scheduler/motion controller unit 122 interacts with the stations and loop feed sensors to govern a spacer stock size, a spacer assembly size, stock feeding speeds in the line, and other parameters involved in production. A preferred controller unit 122 is commercially available from Delta Tau, 21314 Lassen St. Chatsworth, Calif. 91311 as part number UMAC.

The Roll Former 210

Figure 5:
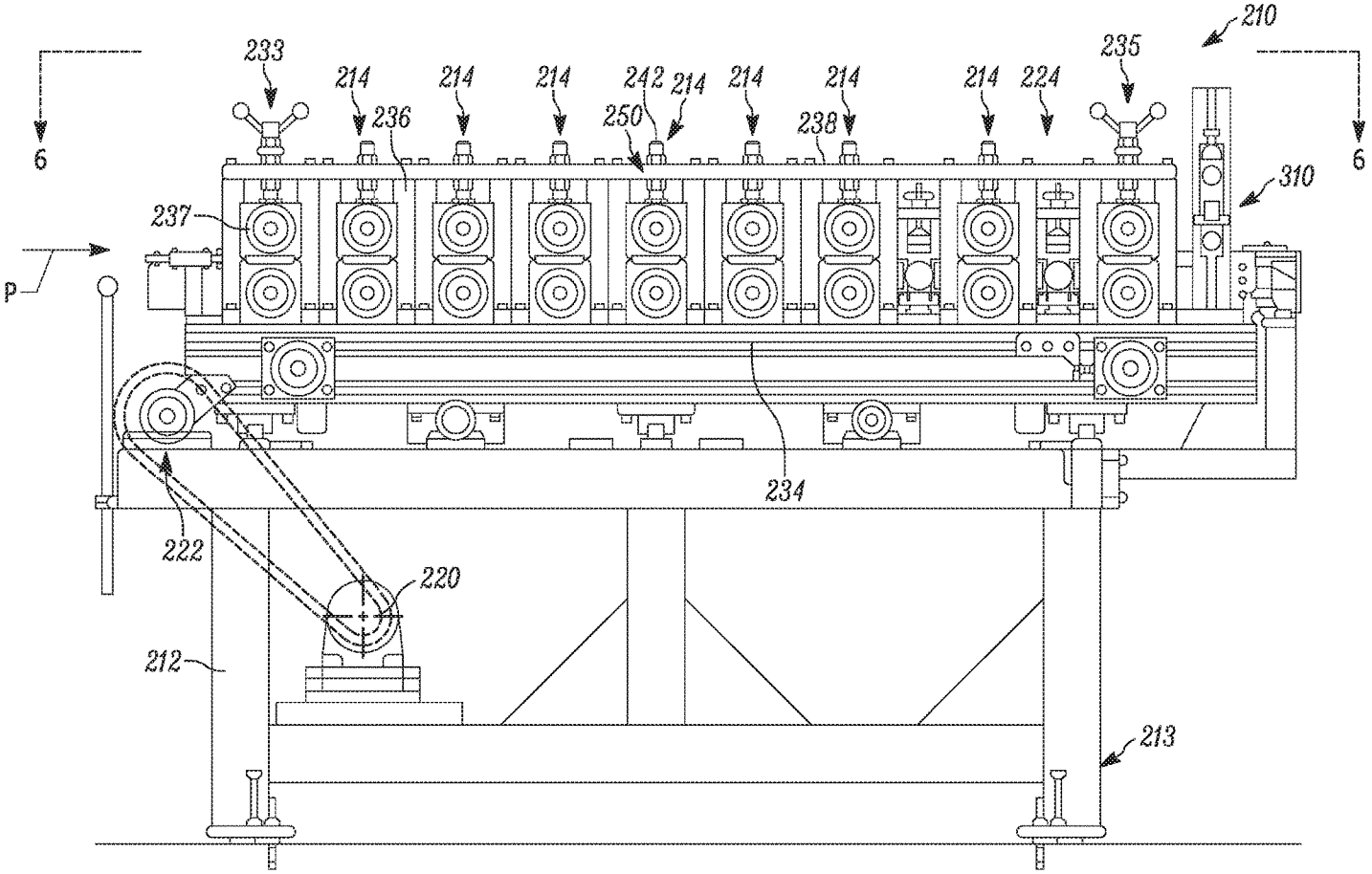
FIG. 5 depicts a front view of a roll forming apparatus for use with a crimping assembly in accordance with one example embodiment of the present disclosure.
Figure 6:
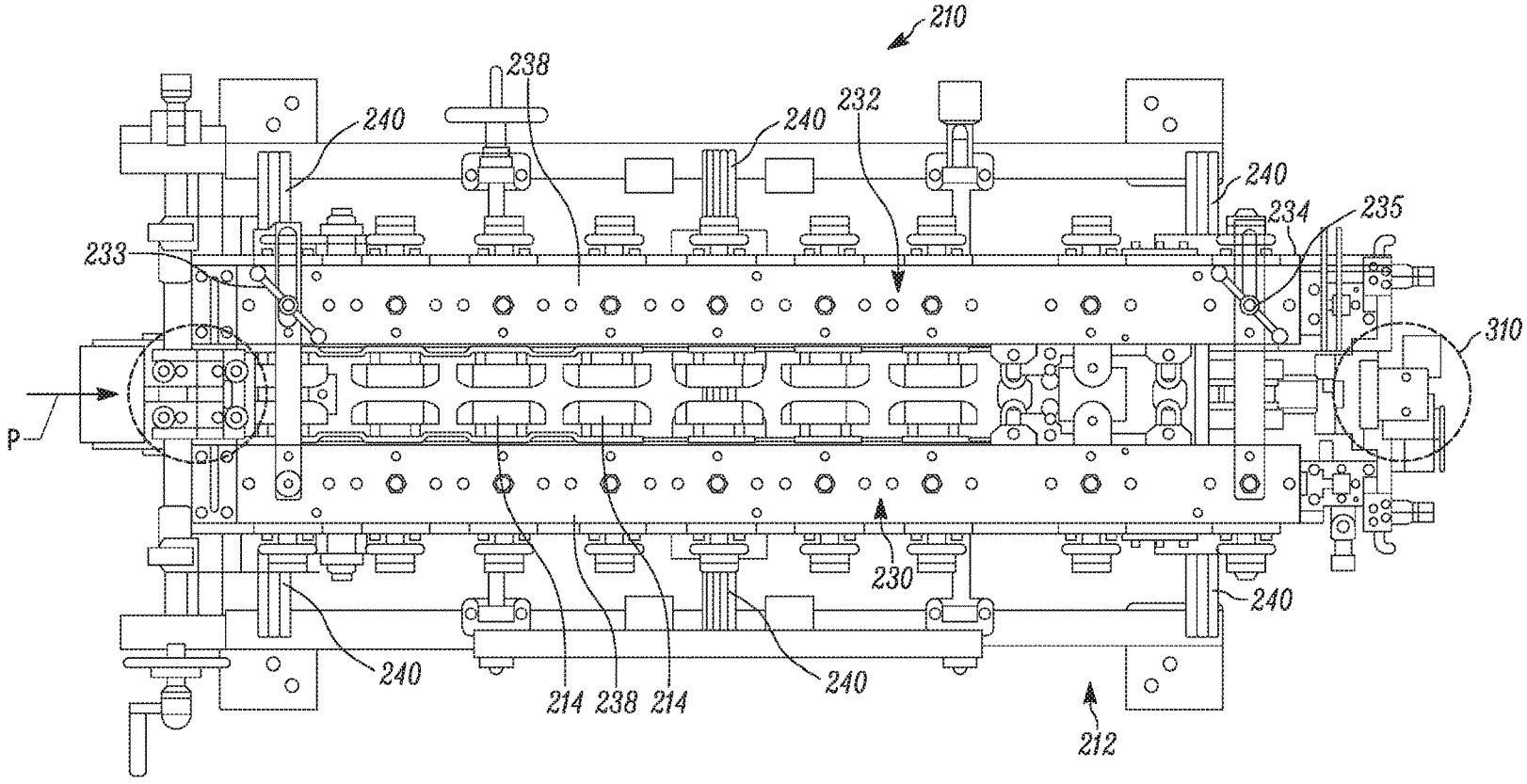
FIG. 6 depicts a top view of FIG. 5 in accordance with one example embodiment of the present disclosure.
Figure 7:
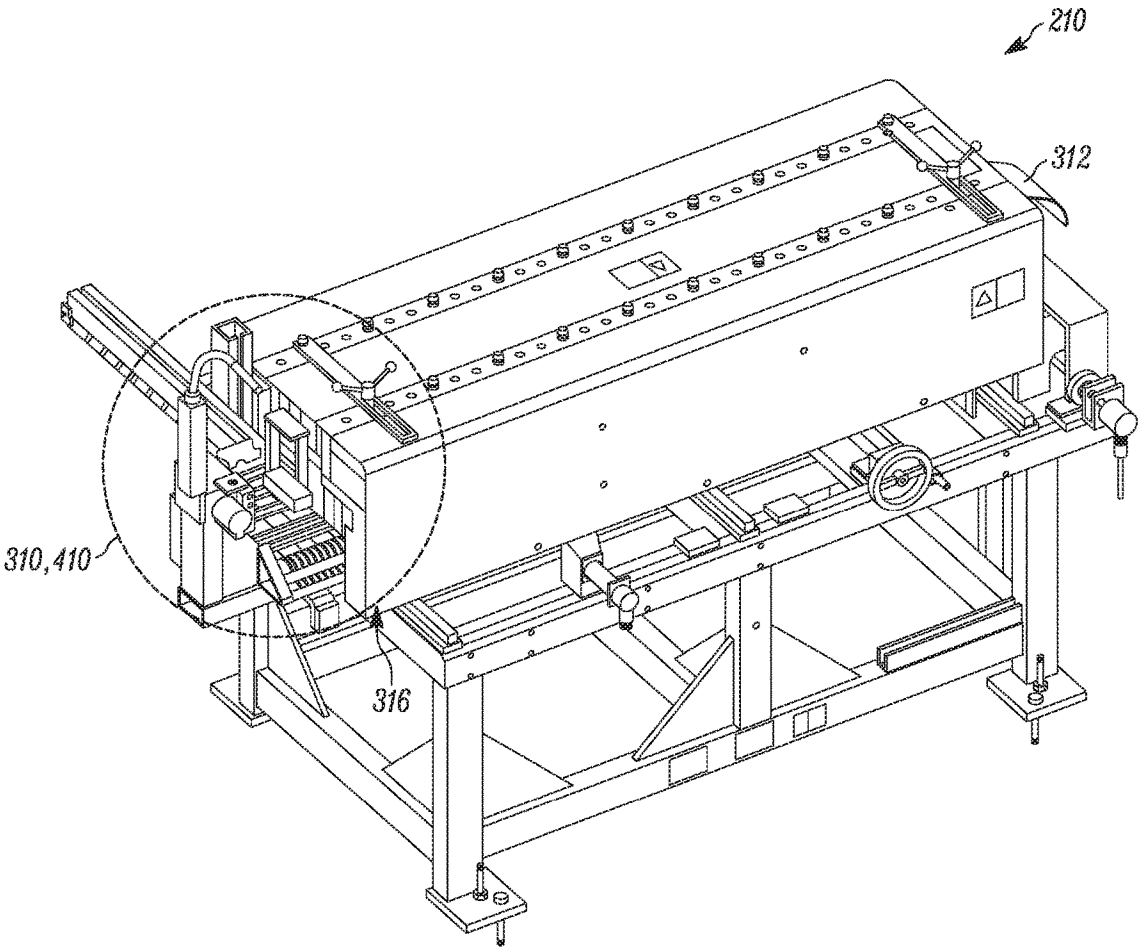
FIG. 7 depicts a perspective view of a roll forming apparatus for use with a crimping assembly in accordance with one example embodiment of the present disclosure.
Figure 8:
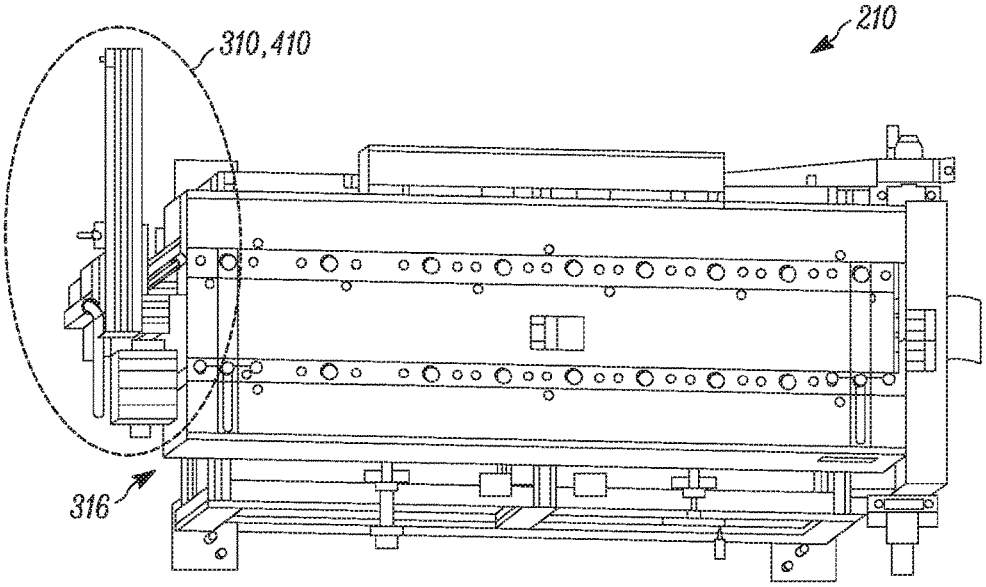
FIG. 8 depicts a top view of FIG. 7 in accordance with one example embodiment of the present disclosure.

Referring to FIGS. 5 and 6, the forming station 210 is preferably a rolling mill comprising a support frame structure 212, roll assemblies 214 carried by the frame structure 212, a roll assembly drive motor 220, a drive transmission 222 coupling the drive motor 220 to the roll assemblies, and a system enabling the forming station 210 to roll form stock having different widths.

The support frame structure 212 comprises a base 213 fixed to the floor and first and second roll supporting frame assemblies mounted atop the frame structure. The base 213 positions the frame assembly 224 in line with the stock path of travel P immediately adjacent a transfer mechanism, such that a fixed stock side location of a stamping station that cuts notches at corner locations is aligned with a fixed stock side location of the roll forming station 210.

Referring to FIG. 6, the roll supporting frame station 210 include a fixed roll support unit 230 and a moveable roll support unit 232 respectively disposed on opposite sides of the path of travel P. The units 230, 232 are generally mirror images, with the exception that unit 232 is moveable and unit 230 is fixed. Components that allow unit 232 to move are not included in unit 230. As illustrated in FIG. 5, each of the units 230, 232 comprises a lower support beam 234 extending the full length of the rolling mill, a series of spaced apart vertical upwardly extending stanchions 236 fixed to the lower beam 234, one pair of vertically aligned mill rolls 237 received between each successive pair of the stanchions 236, and an upper support bar 238 fixed to the upper ends of the stanchions.

Each mill roll pair 237 extends between a respective pair of stanchions 236 so that the stanchions provide support against relative mill roll movement in the direction of extent of the path of travel P as well as securing the rolls together for assuring adequate engagement pressure between rolls and the stock passing through roll nips. The upper support bar 238 carries three spaced apart linear bearing assemblies 240 on its lower side. Each linear bearing 240 is aligned with and engages a respective trackway so that the upper support bar 238 may move laterally toward and away from the stock path of travel P on the trackways.

Each roll assembly 214 is formed by two roll pairs 237 aligned with each other on the path of stock travel to define a single "pass" of the rolling mill. That is to say, the rolls of each of the two roll pairs 237 have parallel axes disposed in a common vertical plane and with the upper rolls of each pair and the lower rolls of each pair being coaxial. The rolls of each of the roll pairs 237 project laterally towards the path of stock travel P from their respective support units 230, 232. The projecting roll pair ends are adjacent each other with each pair of rolls constructed to perform the same operation on opposite edges of the stock. The roll nip of each roll pair 237 is spaced laterally away from the center line of the travel path. The roll pairs 237 of each roll assembly 214 are thus laterally separated along the path of travel.

The upper support bar 238 carries a nut and screw three adjuster 250 associated with each upper mill roll for adjustably changing the engagement pressure exerted on the stock at the roll nip. The adjuster 250 comprises a screw 242 threaded into the upper support bar 238 and lock nuts for locking the screw in adjusted positions. The adjusting screw is thus rotated to positively adjust the upper roll position relative to the lower roll. The lower support beam 234 fixedly supports the lower mill roll of each of the roll pairs 237. The adjusters 250 enable the vertically adjustable mill roll pairs 237 to be moved towards or away from the fixed mill rolls to increase or decrease the force with which the roll assemblies engage the stock passing between them.

The drive motor 220 is preferably an electric servomotor driven from the controller unit 122. As such the motor speed can be continuously varied through a wide range of speeds without appreciable torque variations.

Whenever the motor 220 is driven, the rolls of the roll pairs 237 of each roll assembly 214 are positively driven in unison at precisely the same angular velocity. Roll sprockets of successive roll pairs 237 are identical and there is no slip in a chain attaching the rolls of the roll pairs 237 so that the angular velocity of each roll in the rolling mill is the same as that of each of the others. The slight difference in roll diameter provides for the differences in roll surface speed referred to above for tensioning the stock without distorting it.

In the exemplary embodiment, the distance between the units 230, 232 is manually adjusted to adapt the roll forming station 210 to the width of sheet stock to be presented to roll forming station. In the illustrated example embodiment of FIG. 6, two adjustable hold down members 233, 235 are loosened and the unit 232 shifts the moveable rolls laterally towards and away from the fixed roll of each roll assembly 214 so that the stock passing through the rolling mill can be formed into spacer frame members 30*a*-30*d* having different widths. The drive transmission 222 is preferably a tinting belt reeved around sheaves on the drivescrews.

Crimping Assembly 310

Figure 9:
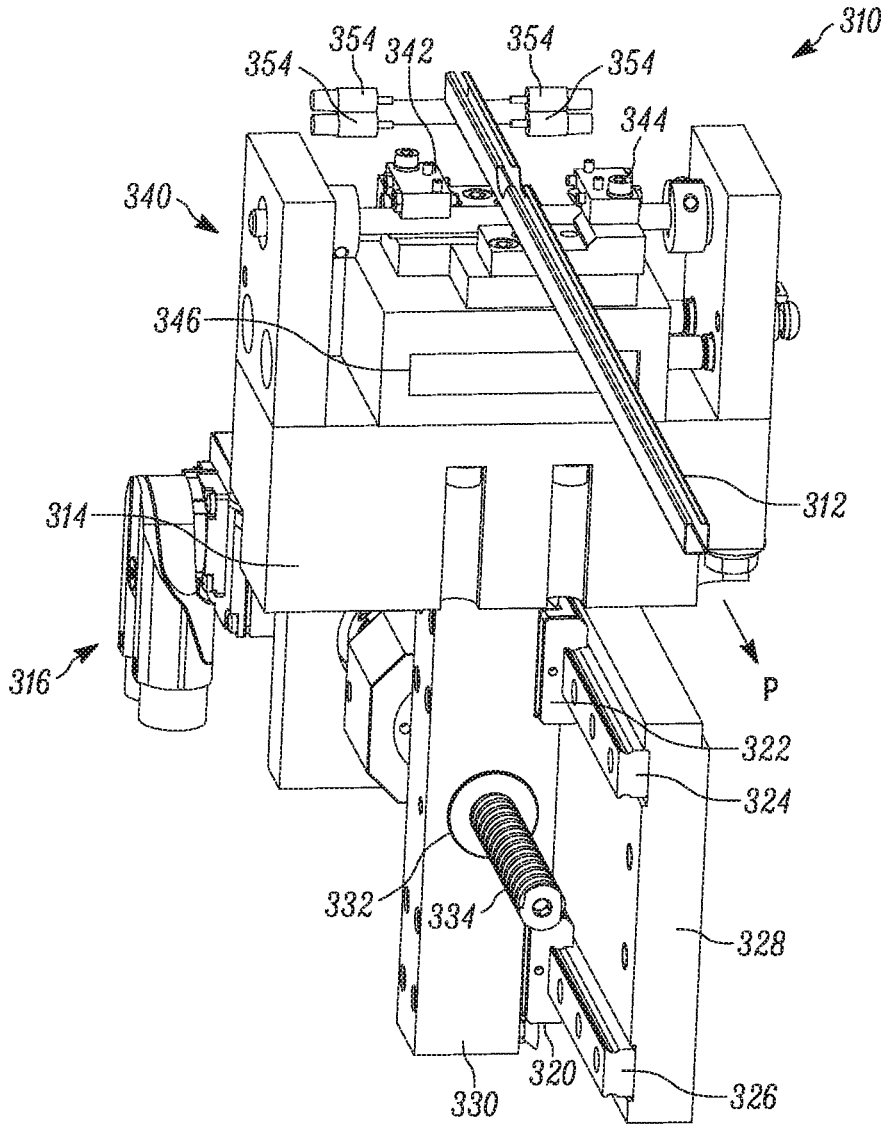
FIG. 9 depicts a first front perspective view of a crimping assembly constructed in accordance with one example embodiment of the present disclosure.
Figure 10D:
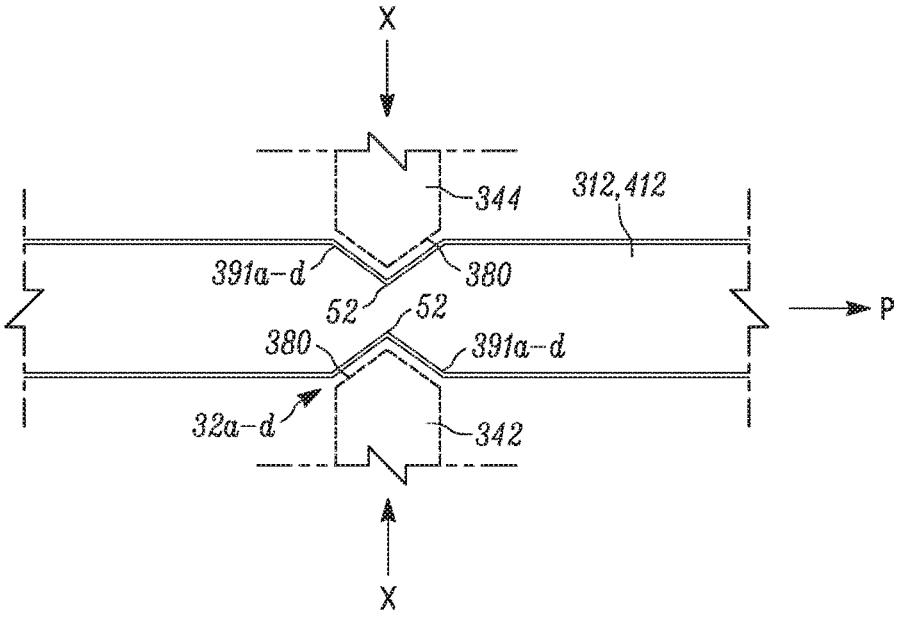
FIG. 10D depicts a top plan view of crimper fingers simultaneously engaging the metal strip along a line of weakness to form folds transverse to a path of travel.
Figure 11:
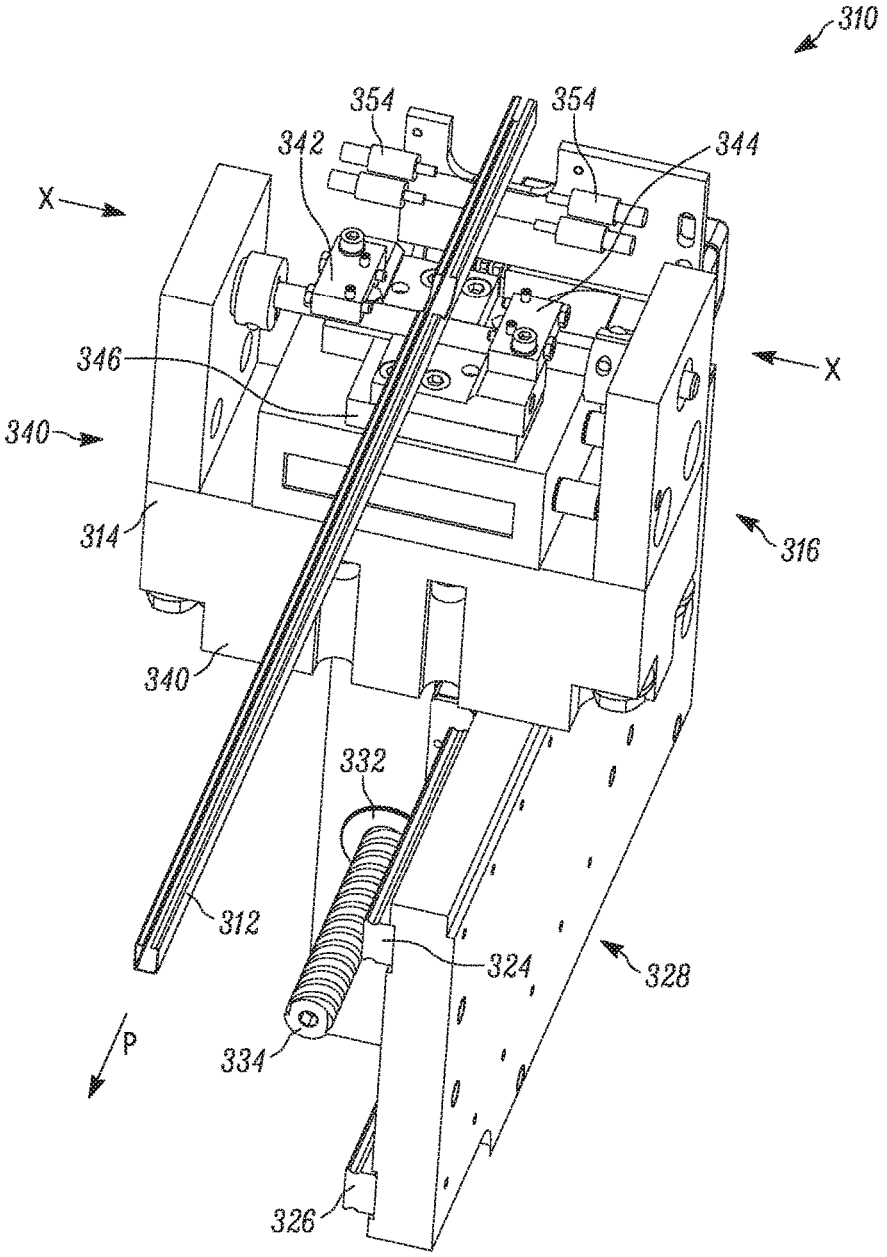
FIG. 11 depicts is second front perspective view of a crimping assembly constructed in accordance with one example embodiment of the present disclosure.
Figure 12:
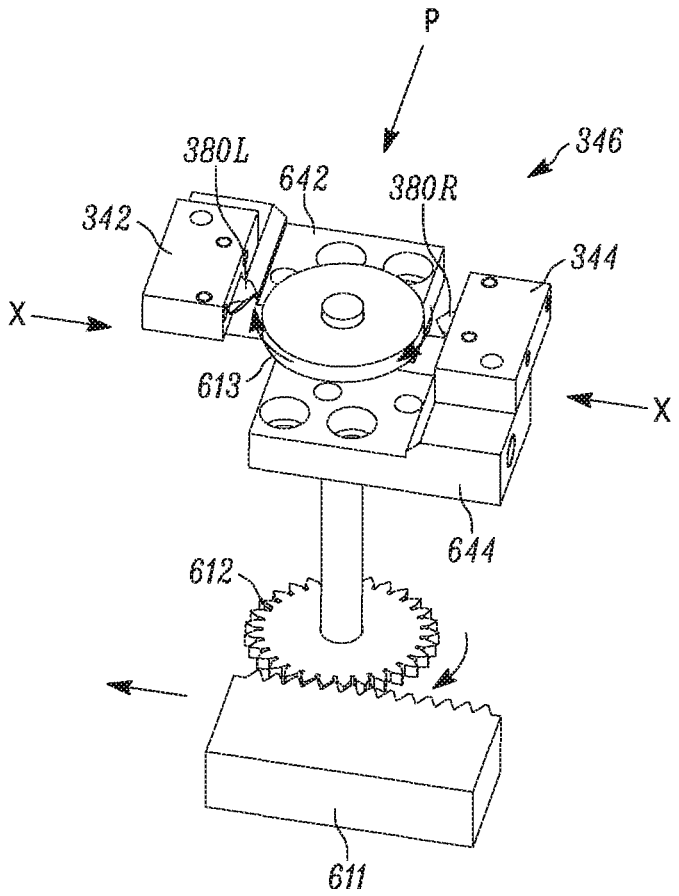
FIG. 12 depicts a perspective view of a double acting rack coupled to crimping fingers in accordance with one example embodiment of the present disclosure.
Figure 13:
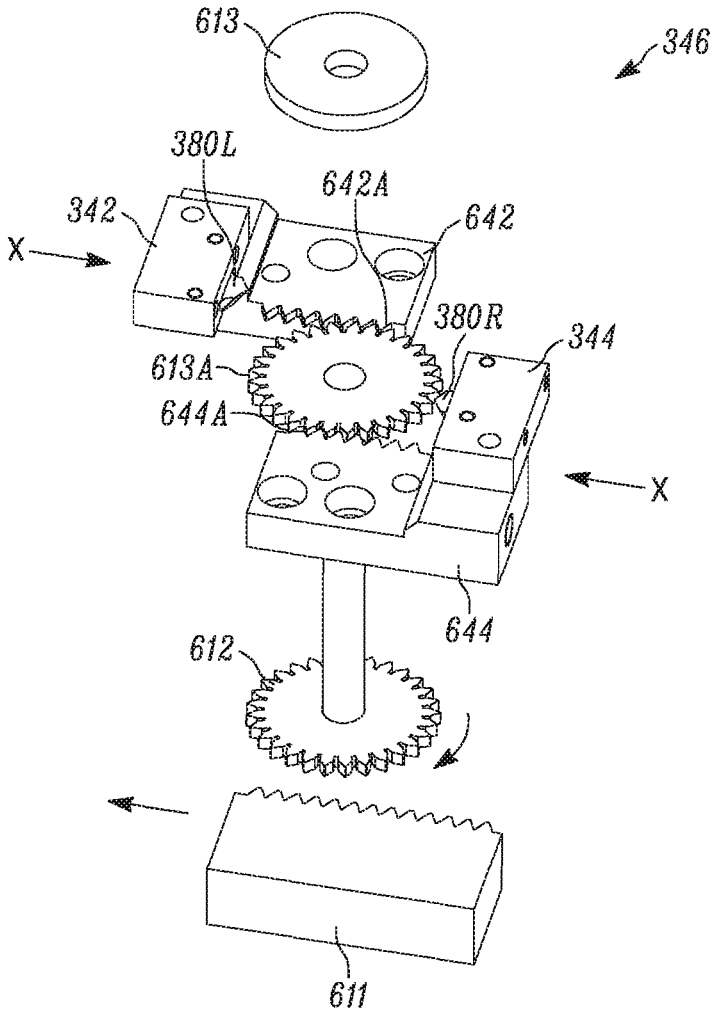
FIG. 13 depicts an exploded perspective view of FIG. 12 in accordance with one example embodiment of the present disclosure.
Figure 14:
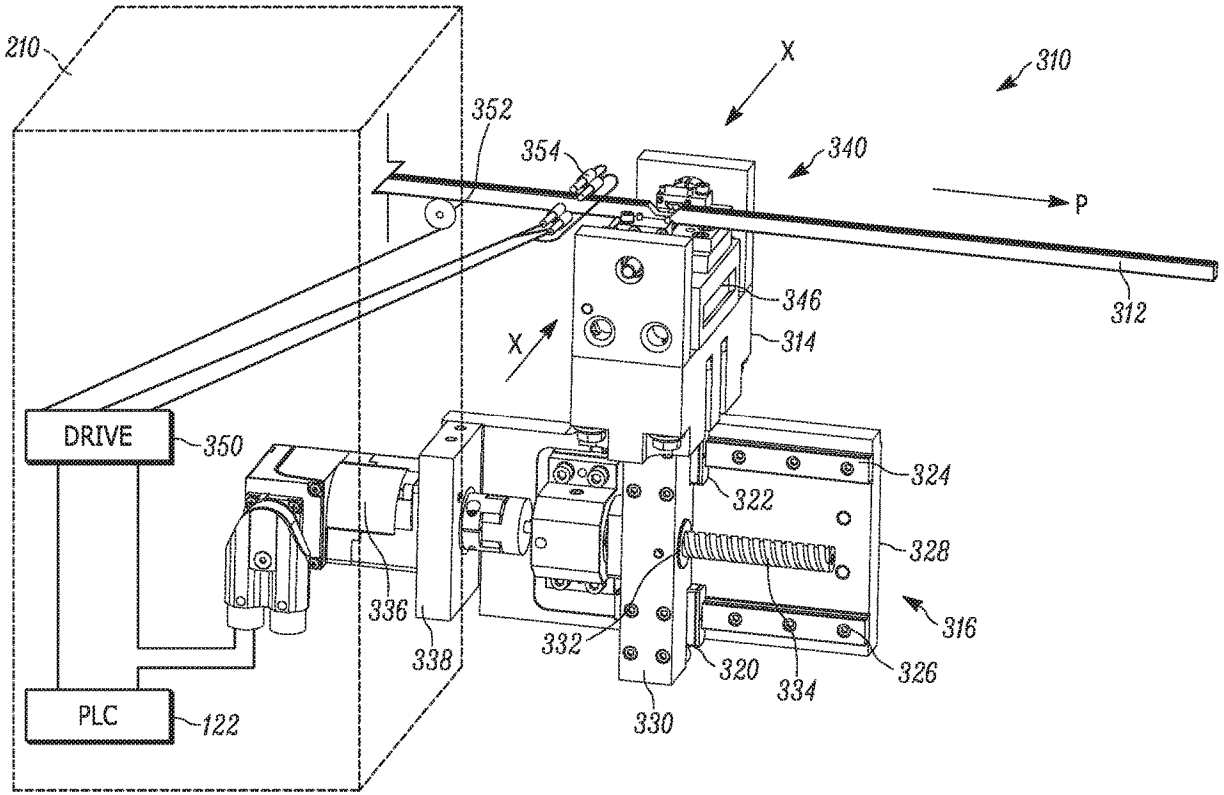
FIG. 14 depicts a side perspective view of a crimping assembly constructed in accordance with one example embodiment of the present disclosure.

As illustrated in FIGS. 5-14, a crimping assembly 310 is connected to an output end of the roll former 210 and processes the strip 312 of steel that has been bent by the roll former 210. The crimping assembly 310, as illustrated in FIGS. 9, 11, and 14, has a single movable carriage 314 that is coupled to linear bearings 320, 322, which move along spaced apart generally parallel tracks or guides 324, 326 that extend away from the exit side 316 of the roll former 210.

As illustrated in the example embodiment of FIG. 14, the tracks or guides 324, 326 are attached to a weldment or fixture 328 along the production line 100, and more particularly in line with the roll former 210 such that the strip 312 moves in an aligned path of travel "P" through both the roll former and the crimping assembly 310. The carriage 314 is attached on a top of a slide detail 330 having a threaded insert 332 for receiving a screw gear or ball screw 334. In one example embodiment, the carriage 314 is attached to a linear actuator 334, which advances the carriage along the path of travel "P." One of ordinary skill in the art would appreciate that multiple versions or types linear actuator, such as ball screws, linear bearings, etc. with high precision can be employed.

The crimping assembly 310 further comprises a motor 336 coupled to the ball screw 334. An example of a suitable motor 336 is sold by B& R of Austria under part number 8LV A13.B103D000-0. The motor 336 is attached to the weldment 328 with a mounting block 338.

Nested atop the carriage 314 is a crimping arrangement 340. The crimping arrangement 340 comprises first and second crimping fingers 342, 344, respectively that are directly opposing each other on opposite sides of the u-shaped strip 312. The fingers 342, 344 simultaneously collapse on the strip 312 when actuated, the actuation controlled by double acting cylinder rack 346.

In the illustrated example embodiment of FIGS. 12-13, the double acting cylinder rack 346 includes a main cylinder coupled to a main rack 611 that drives a main gear 612. The main gear 612 when actuated turns a central pinion gear 613, advancing on opposite sides of the pinion respective racks 642, 644 coupled to the respective fingers, 342, 344, allowing for simultaneous engagement and deformation of the strip 312 at weakening zones, associated with the central line of weakness 52, at a direction "X" transverse to the path of travel P to form folds 391 on the strip, as illustrated in FIGS. 10C-10D. In the illustrated example embodiment of FIG. 13, the pinion gear 613 comprises gear teeth 316A around a periphery which engages corresponding teeth 642A, 644A on racks 642, 644. An example of a suitable double acting cylinder rack 346 is a pneumatic cylinder sold by Climatic USA, located in Cleveland, Ohio under part number PE-1625. The specification of the pneumatic double acting cylinder rack being incorporated herein by reference.

In the illustrated example embodiment of FIG. 14, the motion and operation of the crimping assembly 310 is synchronized through electrical gearing. More specifically, the crimping assembly 310 communicates with the controller or plc 122, which collectively communicates with the crimper assembly's electrical gearing drive 350, motor 336, encoder 352, and sensors 354. The encoder 352 is locate upstream from the crimper carriage 314 along the path of travel P and the encoder measures the velocity of the strip 312, communicating such velocity to the drive 350 and plc 122. The electrical gearing drive 350 then uses the measured velocity of the strip 312 to accelerate the carriage 314 (via motor 336 and ball screw 334) from a stationary position along the path of travel P to allow the crimping fingers 342, 344 to engage the strip 312 in the region of the central line of weakness 52. The ball screw 334 after accelerating the carriage 314 along the path of travel returns the carriage to a home and/or stationary position, as illustrated in FIG. 14, until a next notch passes by the encoder 252.

The sensors 354 form a light curtain 356 (see FIG. 10B) to sense the notch 360 at the front of the strip 312 that is a known distance to the subsequent lines of weaknesses 52 along the strip, requiring crimping from the crimping fingers 342, 344. The light curtain 356 comprises a plane of light transverse and/or perpendicular to the strip 312. The light curtain 356 detects various points along the strip 312, such as points A-H in FIG. 10B to reassure locations of the lines of weakness 52 are engaged by points 380 (see FIGS. 13, 15) of the fingers 342, 344 as the carriage 314 is being moved along the path of travel P. The light curtain 356 further allows a sufficient reading of points A-H despite possible bouncing or movement of the strip 312 along the path of travel P. In example embodiment, because the light curtain 356 senses a plane perpendicular to the strip 312 that encompasses multiple points on the strip, the notch 360 is sensed relative to the overall strip. Thus, even when the strip 312 is bouncing, the notch 360 is sensed because the light curtain 356 is sensing a relative change in shape of the strip created by the notch, rather than relying on an absolute position or height of the strip.

In one example embodiment, the strip 312 travels at one hundred (100 ft/min) feet per minute and the carriage 314 is accelerated at 1000 inches per second squared during which time the crimping fingers 342, 344 are actuated to engage the strip 312 at multiple locations (for example at least four times for a four corner square spacer frame) over the strip 312 at the designated lines of weakness 52. The electrical gearing and crimping assembly 310 allows a single strip 312 to complete one cycle with four folds 391 in only 0.300 seconds, as illustrated in FIGS. 10C-10D). Thus, speed and throughput is increased over conventional spacer frame production lines in which the crimping station was typically the bottleneck, averaging 0.5 seconds per cycle or strip with a conventional mechanical crimper. Thus, the crimping assembly 310 will likely increase a spacer frame production line throughput by 10 to 15% over conventional crimper systems.

One suitable example of an electrical gearing drive 350 is made by B&R of Austria under part number 80VD100PS.C00X.01. One suitable example encoder 336 is made by BEI Technologies located in Thousand Oaks, Calif. under part number HD2F2-F0CDS6-1000. One suitable sensor 354 is made by Keyence Corporation of America located in Itasca, Ill. under part number FUE-11. The above specifications of the commercial components are incorporated herein by reference.

Figure 15:
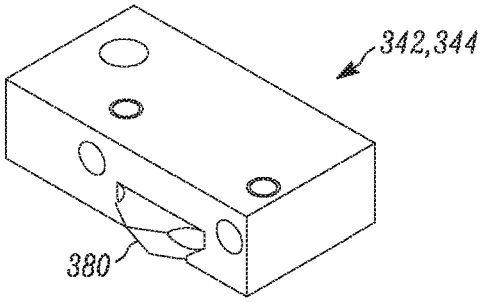
FIG. 15 depicts a perspective view of a crimper finger constructed in accordance with one example embodiment of the present disclosure.

Illustrated in FIG. 15 is one example of crimper fingers 342, 344 that are coupled to the double acting cylinder rack 346. The crimping fingers 342, 344 are made from hardened steel to resist wear. In one example embodiment, the fingers 342, 344 are made from Grade O1 hardened tool steel.

Figure 16:
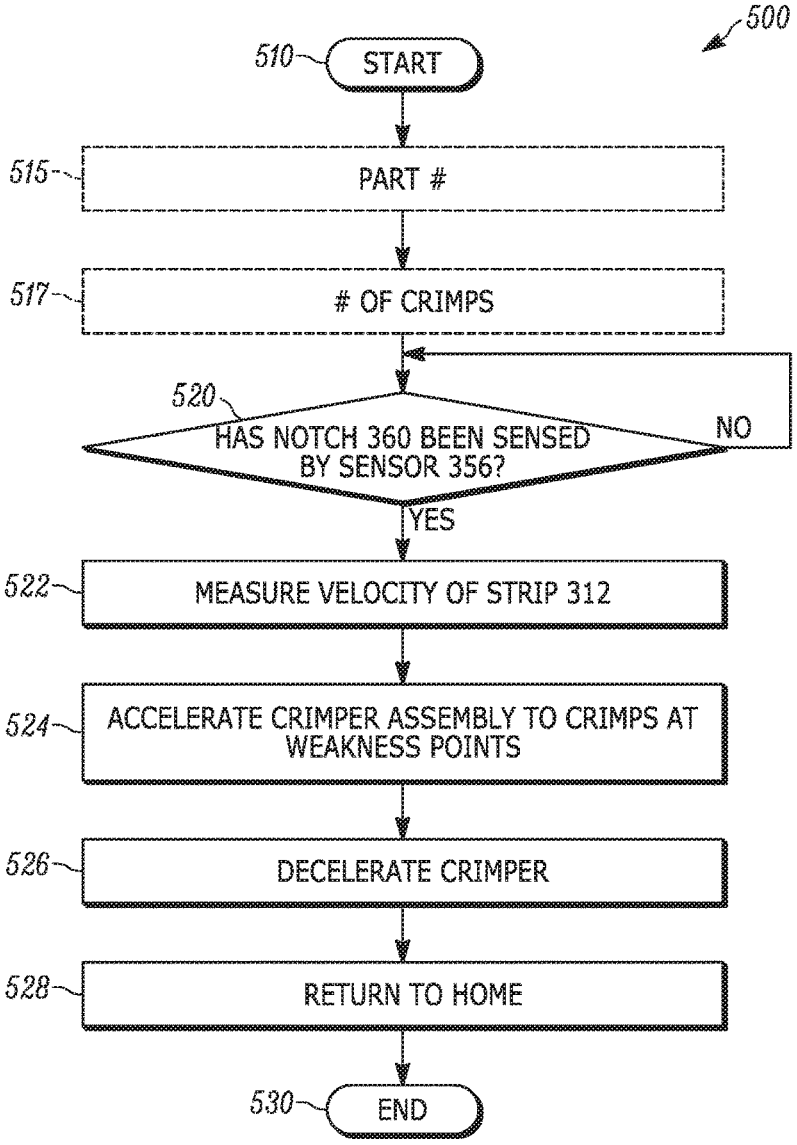
FIG. 16 depicts a process flow diagram representing the operation of a crimping assembly in accordance with one example embodiment of the present disclosure.

Illustrated in FIG. 16 is a process flow diagram, illustrating the controlled operation 500 of the crimping assembly 310 in accordance with one example embodiment of the present disclosure. The process or operation 500 starts at step 510. In one example embodiment, optional steps 515 and 517 occur, wherein at step 515 a part number associated with a strip 312 is tracked. At step 517, the part number indicates the number of crimps and the locations or spacing of the lines of weakness 52 between each line and from the notch 360. At 520, the process 500 employs a sensor 354 to detect one or more points (see A-H in FIG. 10B) of the notch 360. If the notch 360 is detected by the sensor 354, the process 500 advances to step 522. If no notch 360 is sensed, it returns and continues through a loop at 520.

At 522, the process 500 uses electrical gearing in combination with the drive 350, plc 122, motor 336, ball screw 334, and encoder 352 to measure the velocity (relatively constant) of the strip 312 moving through the roll former 210 to the crimping assembly 310. At 524, the carriage 114 of the crimping assembly 310 is accelerated in the direction of the path of travel from the stationary or home position to reach the velocity of the strip 312 at the first crimping point of the strip, so that the crimping points 380 of fingers 342, 344 engage simultaneously the first line of weakness 52 at a first corner structure 32*a*.

At 526, the carriage 314 of the crimping assembly 310 using the electrical gearing is then decelerated so that the strip 312 advances through the crimping assembly at a velocity greater than the velocity of the carriage along the path of travel P. Once the second line of weakness 52 is sensed, the carriage 314 is accelerated in the direction of the path of travel P to reach the velocity of the strip 312 to align the points 380 of the fingers 342, 344, with the second line of weakness 52. The fingers 342, 344 and more specifically points 380 engage the second line of weakness at a second corner structure 32*b*. In an example embodiment, the carriage 314 returns to the home position after each actuation of the fingers 342, 344. In another example embodiment, the carriage 314 returns to the home position after each four actuation of the fingers 342, 344. The acceleration and deceleration steps 524, 526 continue for the desired number of bends or corner structures 32*c*, 32*d* . . . 32*n* (e.g., where n is typically 4 for a four sided spacer frame) until all the desired folds on the strip 12 that will form the desired number of corner structures 32 are formed. In an example embodiment, depending on a length of the strip 312, a desired distance between corner structures, etc., the carriage 314 returns to the home position and then resume steps 524, 526, until the desired number of folds on the strip are formed. At 528, the process continues by returning the carriage 314 to the home or stationary position in which the carriage 314 started at 510 and as illustrated in FIG. 14.

In one example embodiment, the notch 360 is also the first corner structure 32*a*. In an alternative example embodiment, the notch is a different configuration from that of the corner structure that is detectable by the window 356 of the sensor 354. It should be appreciated that the electrical gearing using the combination of the sensors 354 and the known distance of the folds or corner structures allows the fingers 342, 344 to accelerate and decelerate at a rate that provides for precise contact along the lines of weakness 52 throughout the strip 312.

During operation, the crimping assembly 310 watches for the notch 360 located at a first end of the strip 312, which can be the front portion of the strip as it passes though the sensors 354 or one or multiple parts of the first corner of the strip 312, for A, B, C, D, E, F, G, and H as illustrated in FIG. 10B. FIG. 10A is perspective view of a portion of a metal strip 312 moving along a path of travel P. FIG. 10B is a side perspective view of a portion of a metal strip 312 moving along a path of travel P being scanned by the light curtain 356 of the sensor 354 to detect various points on the strip, for example points A, B, C, D, E, F, G, and H in FIG. 10B. After the fingers 342, 344, and more particularly the points 380 of the fingers simultaneously engage of the strip 312, folds 391 are formed as illustrated in the top view of FIG. 10D. Illustrated in FIG. 10C is an upper perspective view of the metal strip 312 after being crimped to form folds 391 by the crimping assembly 310.

Figure 17:
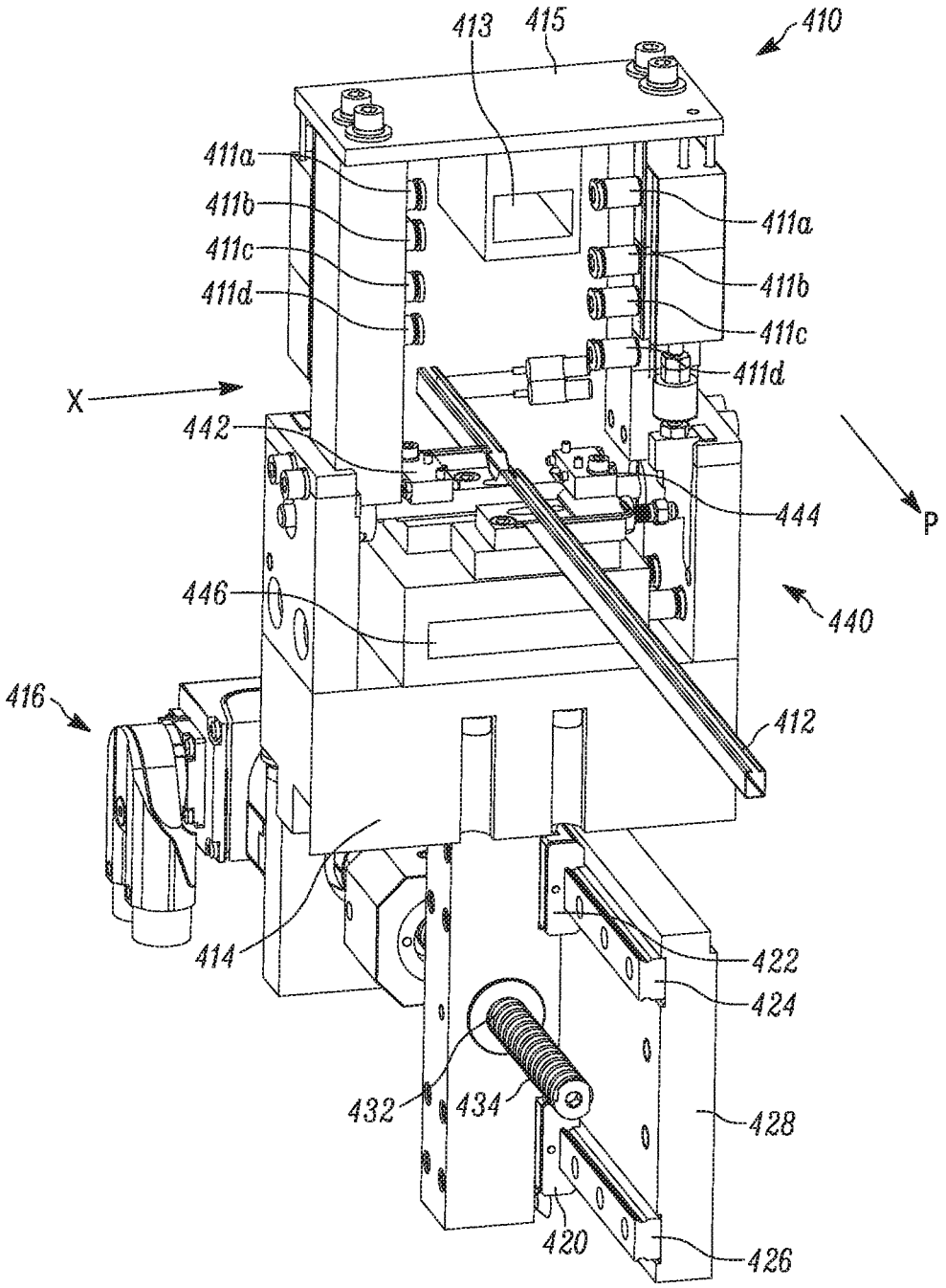
FIG. 17 depicts a first front perspective view of a crimping assembly constructed in accordance with another example embodiment of the present disclosure.
Figure 18:
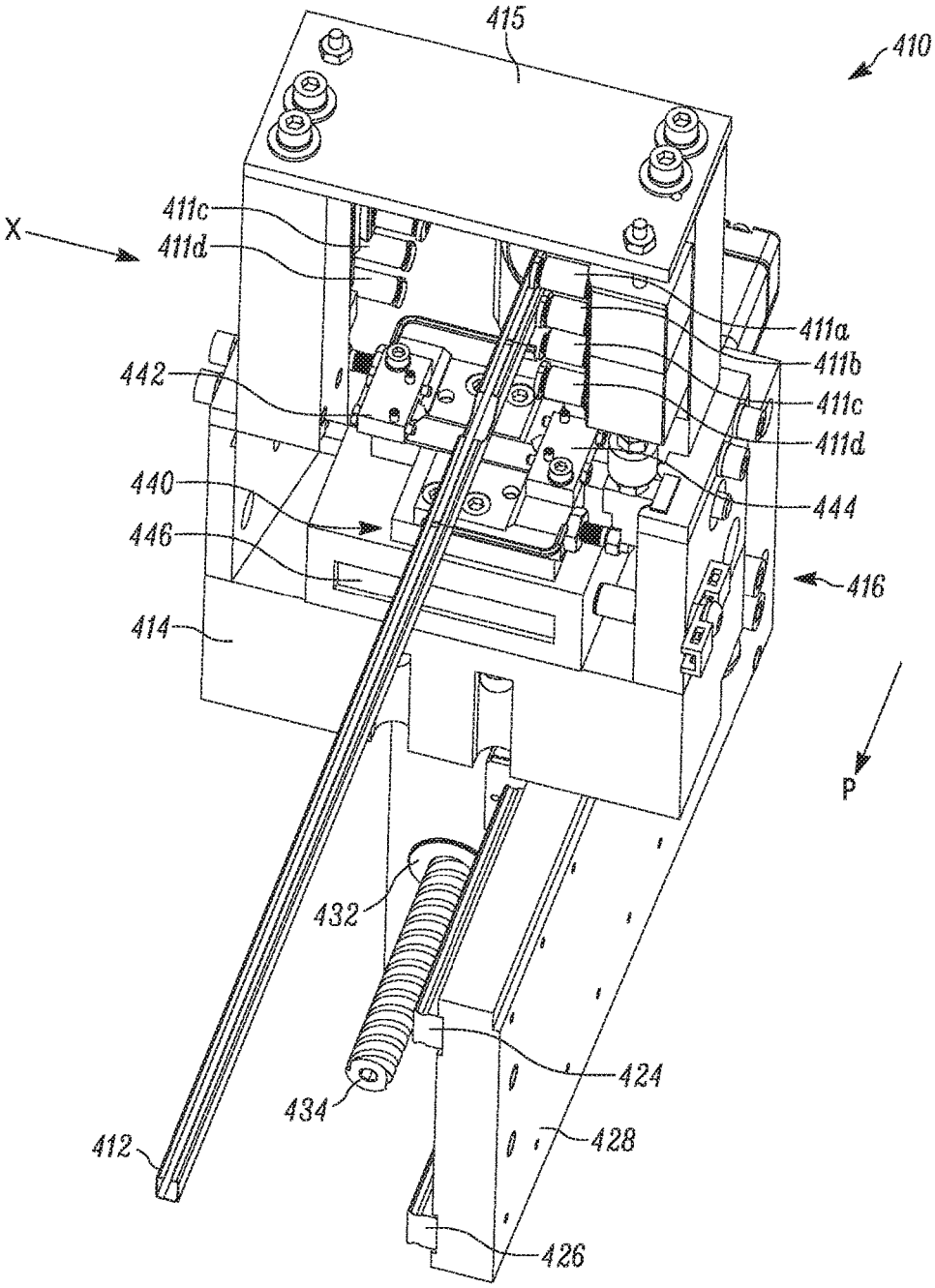
FIG. 18 depicts a second front perspective view of a crimping assembly constructed in accordance with another example embodiment of the present disclosure.
Figure 19:
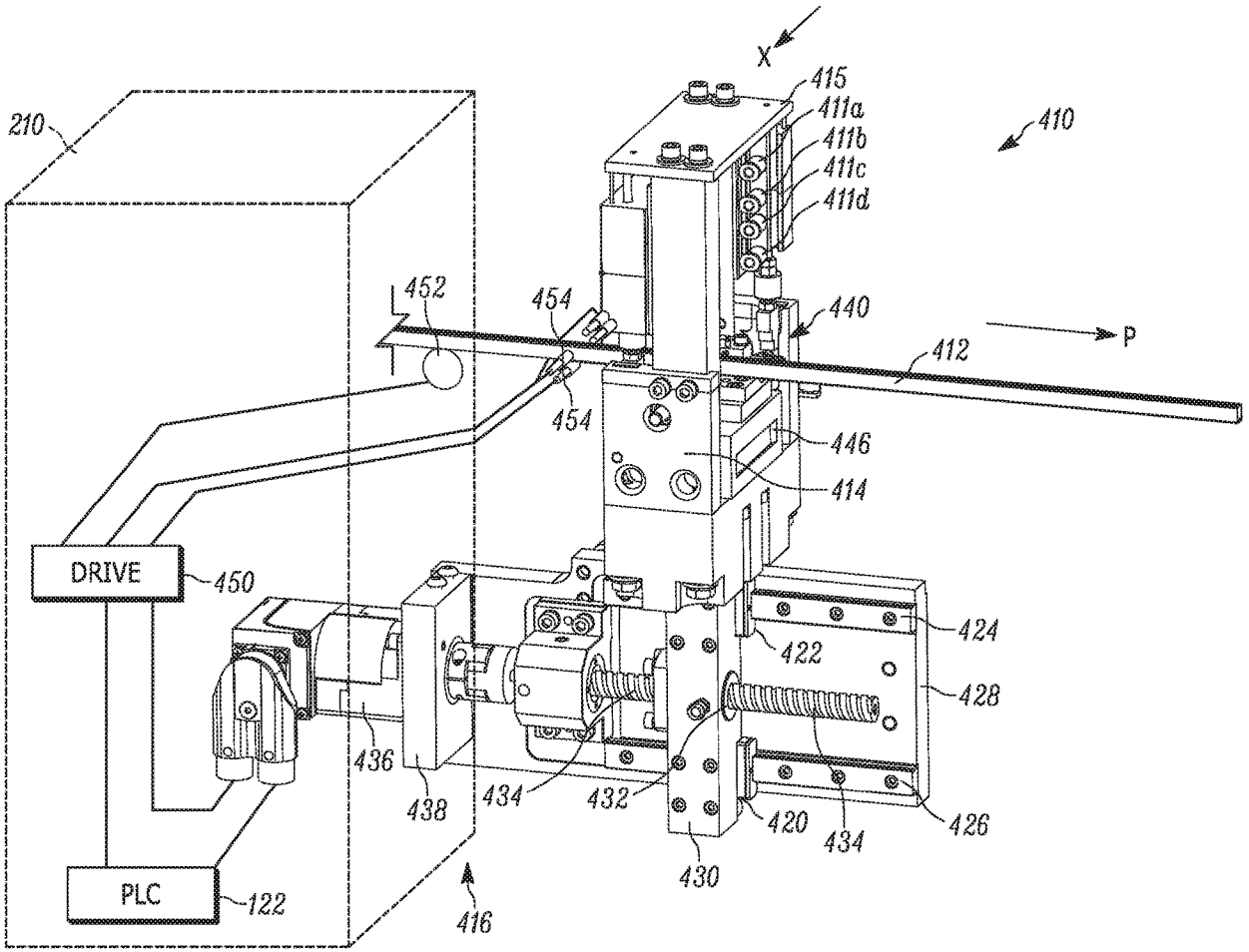
FIG. 19 depicts a side perspective view of a crimping assembly constructed in accordance with another example embodiment of the present disclosure.

Referring now to FIGS. 17-19 a crimping assembly 410 constructed in accordance with another example embodiment is illustrated. The crimping assembly 310 as illustrated in FIGS. 7-9, 11, and 14 is substantially similar to the crimping assembly 410 as illustrated in FIGS. 17-19 with shared features being identified by the same numeral increased by a factor of 100 from 300 to 400. A primary change from the crimping assembly 310 is that the crimping assembly 410 includes sensor stops 411*a*-411*d* that comprise a number of sensors that are positioned within a fixture tower 415. The sensor stops 411*a*-411*d* provide a second check that the crimping point 380 is directly in-line with the line of weakness 52 for each corner structure 32*a*-32*d*. The sensor stops 411*a*-411*d* provide a sensor window 413 that is directly in-line with the crimpers 442, 444 and detect when the crimpers should engage the line of weakness 52 of each corner structure 32*a*-32*d*. In one example embodiment, the sensor stops 411*a*-411*d* correspond to a respective corner structure 32*a*-32*d*. In another example embodiment, the sensor stops 411*a*-411*d* act as the sole initiator of the fingers 442, 444 to engage the strip 412 as instructed by the plc 122 once the sensor 454 detects the respective corner 32 assigned to each stop. In another example embodiment, the sensor stops 411*a*-411*d* determine a width of the strip 412 and responsive to the width of the strip being below a threshold, the fingers 442, 444 will not return to an original position after actuation, but will reside in a secondary position where the fingers are nearer to each other when in a non-actuating position based upon the determined thickness of the strip. In an example embodiment, responsive to the sensor stops 411*a*-411*d* determining that a width of the strip 412 is 1 inch, the plc 120 will stop the fingers 442, 444 post actuation when the points 380 of the fingers are separated by 2 inches, wherein the points of the fingers where initially separated by 5 inches. It would be understood by one in the art that many different distances between the points 380 of the fingers 442, 444 may be utilized.

During operation, as illustrated in FIG. 19, the metal strip 412 is formed and advanced through the production line 100. As the strip 412 passes through the roll forming operation 210, the encoder 452 measures the velocity of the strip, which is communicated by conventional I/O to the plc 122 and drive 450. Upon detecting the notch 360 or starting point along the strip 412 as illustrated in FIGS. 10A-10C, the crimp assembly carriage 414 is accelerated by electrical gearing that occurs in microseconds from the combination of the drive 450, plc 122, motor 436 and ball screw 434 working in combination with firmware operating within the plc and drive to actuate the double acting rack assembly 446 for moving the fingers 442, 444 into and out of engagement with the strip 412. In one example embodiment, the plc 122 has a number of part numbers within a lookup table, wherein spacing between corner structures 32 are provided along with the spacing from the notch 360 to the first corner 32*a*, or alternatively, indicates the first corner is acting as the notch.

When the notch 360 or first corner 32*a* is detected, the carriage 414 is accelerated by the turning of the motor 436 and ball screw 434 in which it is coupled in the direction of the path of travel P until it reaches the first line of weakness 52. At which time, the velocity of the strip 412 is maintained by the carriage 414 as the fingers 442, 444 engage the u-shaped strip 412 in the direction X transverse to the path of travel, forming the first fold 391*a* simultaneously on both sides of the strip, as illustrated in FIG. 10D. The carriage 414 is then decelerated until the second and subsequent fold lines are aligned with the finger points 380, as illustrated in FIG. 15, at which time constant velocity with the strip 412 is maintained while the second through subsequent folds 391*b* . . . 391*n* are formed. Once the last desired fold 391*n* is formed, the motor 458 direction and ball screw's 434 direction are reversed, returning the carriage 414 to a home position in which the process is repeated for the next approaching spacer frame comprised on the strip 412.

Advantageously, the crimping assembly 310, 410 does not have any mechanical contact with the metal strip 312, 412 except in the location of the folds 391 by points 380. Thus, damage and warranty repairs on spacer frames are minimized when compared to conventional mechanical crimping assemblies in which the carriage mechanically contacts and is pulled by the strip as is travels through the production line. In addition, the double acting cylinder rack 346, 446 guarantees that the points 380 of the fingers 342, 344. 442, 444 contact the strip 312, 412 to form folds 391 simultaneously, resulting in less defects such as defects that can occur in misaligned folds with individually firing independent cylinders on opposite sides of the metal spacer strip found in conventional systems. Finally, the no-touch drive of the crimping assembly 310, 410 reduces equipment wear experienced in conventional systems.

In an alternative example embodiment, the crimping assembly 310, 410 after applying each fold 391 returns to the home position. Once back to the home position, the sensor 354, 454 detects the next notch 360 or line of weakness 52, accelerating the crimper 310, 410 and more particularly the carriage 314, 414 and actuating the fingers 342, 344. 442, 444 to form the folds 391 on the next line of weakness. This return to home position as illustrated in FIG. 14 continues until the all the folds in the strip 312, 412 are formed by the crimping assembly 310, 410.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains as list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An apparatus for forming folds at a corner in a spacer frame assembly used in construction of insulating glass unit windows, the apparatus comprising:

a carriage supporting first and second crimping fingers for engaging side walls of a metal strip of a spacer frame stock material, the crimping fingers spaced about a path of travel of the metal strip during operation;

a drive for advancing and retracting said carriage during operation substantially along a portion of said path of travel;

an encoder located along the path of travel for determining a velocity of the metal strip moving along the path of travel; and a double acting rack assembly for actuating the first and second crimping fingers in a direction substantially transverse to the path of travel into and out of engagement with the side walls of the metal strip, wherein said drive comprises a controller for accelerating said carriage along the portion of said path of travel to match the velocity of the metal strip as determined by the encoder.

2. The apparatus of claim 1, comprising a sensor in communication with the controller, the sensor located along the path of travel between the encoder and the carriage, wherein the encoder is located upstream of the carriage.

3. The apparatus of claim 2, wherein the sensor forms a light curtain transverse to the path of travel to detect a notch in the strip.

4. The apparatus of claim 2, wherein the controller additionally activates the double acting rack assembly during movement of the carriage in relation to the path of travel responsive to the first and second crimping fingers being perpendicular to a line of weakness.

5. The apparatus of claim 1, wherein the controller decelerates the carriage after actuating said fingers.

6. The apparatus of claim 1, wherein the carriage comprises a fixture tower comprising one or more sensor stops.

7. The apparatus of claim 6, wherein the one or more sensor stops form a sensor window in line with said fingers to determine a width of the metal strip.

8. The apparatus of claim 1, wherein said first and second crimping fingers comprise first and second crimper points directly opposed to one another across the path of travel.

9. The apparatus of claim 1, wherein the double acting rack for actuating said fingers actuates said fingers at a direction substantially perpendicular to said path of travel.

10. The apparatus of claim 1, wherein said fingers are actuated simultaneously while the carriage is in motion.

11. A method for forming folds at a corner in a spacer frame assembly used in construction of insulating glass unit windows, the method comprising:

sensing a notch utilizing a sensor in communication with a controller, the notch located on a continuously moving metal strip of a spacer frame stock material moving along a path of travel through a crimping assembly;

determining a velocity of the continuously moving metal strip along the path of travel;

responsive to sensing the notch, accelerating the crimping assembly, based upon the velocity, from a home position along the path of travel until first and second crimping fingers of the crimping assembly are even with the notch, the crimping fingers located downstream from the sensor; and actuating the crimping fingers to form a fold in the continuously moving metal strip at a region of the notch.

12. The method of claim 11, comprising decelerating the crimping assembly along the path of travel responsive to actuating the crimping fingers, the decelerating comprising reducing a velocity of the crimper assembly to less than the velocity of the continuously moving metal strip.

13. The method of claim 11, comprising:

responsive to sensing a second notch, accelerating the crimping assembly along the path of travel until crimping fingers of the crimping assembly are even with the second notch; and actuating the crimping fingers to form a second fold in the continuously moving metal strip at the second notch.

14. The method of claim 11, wherein sensing the notch comprises sensing a line of weakness associated with the notch.

15. The method of claim 14, wherein forming the fold comprises actuating the crimping fingers to form the fold along the line of weakness.

16. The method of claim 11, wherein the controller receives at least one of a part number associated with the strip, a location of one or more lines of weakness associated with one or more notches on the continuously moving strip, and a distance between the one or more lines of weakness.

17. The method of claim 11, wherein the sensing comprises forming a sensing curtain to identify the notch and one or more points forming the notch.

18. The method of claim 11, comprising generating a sensing window utilizing one or more sensor stops located in line with the crimping fingers, the sensing window detecting a width of the continuously moving metal strip and instructing the controller to maintain a distance between the crimping fingers between actuations that is based upon said width.

19. The method of claim 11, wherein responsive to a desired number of crimps being formed in the continuously moving metal strip, the crimping assembly returning to the home position.

20. An apparatus for forming folds at a corner in a spacer frame assembly used in construction of insulating glass unit windows, the apparatus comprising:

a carriage supporting first and second crimping fingers, the crimping fingers spaced about a path of travel of metal strips during operation;

a motor coupled to a ball screw assembly, the ball screw assembly advancing and retracting said carriage during operation substantially along a portion of said path of travel;

an encoder located along the path of travel and upstream of the carriage, the encoder measuring a velocity of a metal strip moving along the path of travel;

a sensor located along the path of travel and upstream of the carriage, wherein the sensor forms a light curtain transverse to the path of travel to detect a notch in the metal strip; and an electrical gearing arrangement for accelerating said carriage along the path of travel to match the velocity of the metal strip as determined by the encoder, said electrical gearing arrangement comprising a controller and a double acting rack assembly, the controller being in communication with said motor, said encoder, said sensor, and said double acting rack, the double acting rack for actuating said fingers at a direction substantially transverse to said path of travel.

* * * * *